United States Patent [19]

Flowers et al.

[11] Patent Number: 4,783,581

[45] Date of Patent: Nov. 8, 1988

[54] AIR GAP SWITCH ASSEMBLY

[75] Inventors: Woodie Flowers, Weston, Mass.; Joel S. Spira, Coopersburg; Elliot G. Jacoby, Glenside, both of Pa.

[73] Assignee: Lutron Electronics Co., Inc., Coopersburg, Pa.

[21] Appl. No.: 792,475

[22] Filed: Oct. 29, 1985

[51] Int. Cl.[4] ..... H01H 9/16; H01H 3/04; H01H 3/12

[52] U.S. Cl. ..... 200/332; 200/308; 200/335; 200/153 H; 200/153 L; 315/129; 323/905

[58] Field of Search ..... 200/16 R, 153 M, 153 L, 200/331, 332, 308, 16 D, 16 F, 64, 153 H, 312, 335; 174/55–57; 323/904, 905; 315/129, 136, 291, 362, DIG. 4, DIG. 5

[56] References Cited

U.S. PATENT DOCUMENTS

| | | | |
|---|---|---|---|
| 163,736 | 2/1951 | Bangert | 200/308 |
| 3,746,923 | 7/1973 | Spira et al. | 338/159 |
| 4,262,180 | 4/1981 | Walter | 200/332 |

FOREIGN PATENT DOCUMENTS

| | | |
|---|---|---|
| 0022516 | 1/1981 | European Pat. Off. . |
| 2099222 | 12/1982 | United Kingdom . |

OTHER PUBLICATIONS

Tektronix DFl Display Formatter Brochure, Sep. 1976, Tektronix, Inc.

Marquardt, Marquardt Switches Inc., pp. 8–9.

Catalogue Des Interrupteurs, J & J Marquardt KG, 1978, 3 page brochure.

*Primary Examiner*—A. D. Pellinen

*Assistant Examiner*—H. L. Williams

*Attorney, Agent, or Firm*—Ostrolenk, Faber, Gerb & Soffen

[57] ABSTRACT

An air gap switch assembly with a status indicator that prominently indicates when the switch is in the OFF position and disappears from view when the switch is in the ON position. The status indicator is located on the control lever for the switch, which is formed of a clear material and is difficult to see. The control lever is moveable relative to the housing of the assembly so that when the control lever is in the ON position, the portion of the lever on which the status indicator is located is hidden from view by the housing of the assembly. When the control lever is moved to the OFF position, the portion of the lever on which the status indicator is located is exposed, thereby providing an indication that the switch is in the OFF position. The switch is formed of two contacts which are biased together in electrical contact by an elongated flat metal strip. The control lever is coupled to a cam. When the control lever is moved to the OFF position, the cam abuts against the metal strip, forcing the strip to move in a direction opposite to its bias, thereby separating the two contacts and breaking electrical contact.

28 Claims, 7 Drawing Sheets

46
27
53
56
24
57
62
60
58
64
25
52
54
44
28
42
40
64
36
38
48
34
32
30
82
84
66
72
70
67
53
78
68
80
61
69
85
86
63
76
74
88
76
85
90

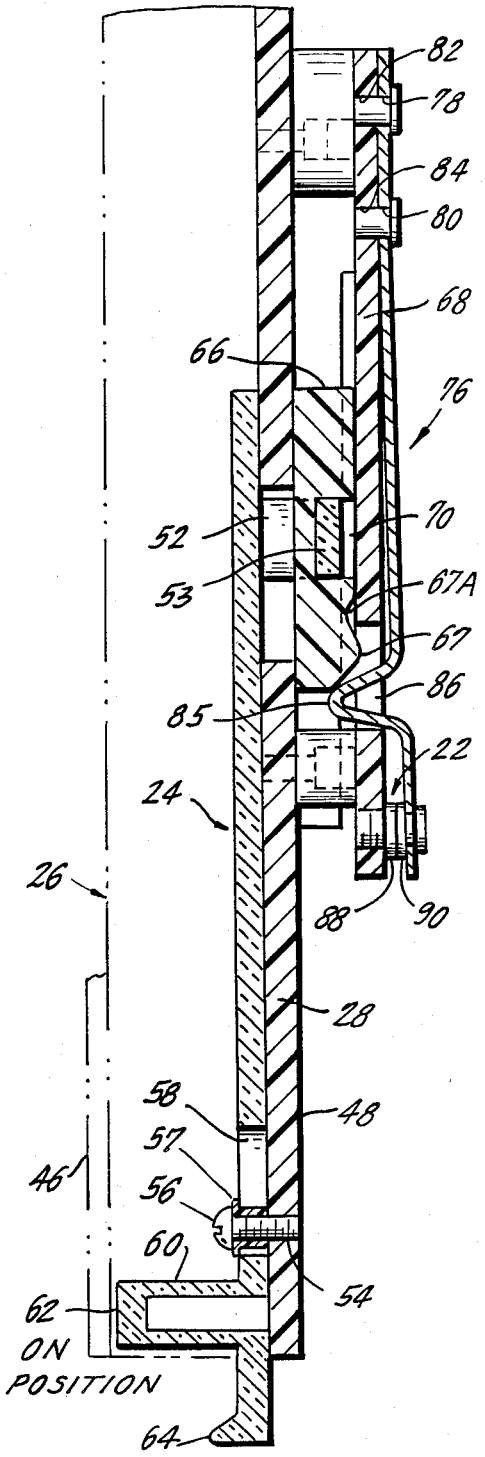
FIG. 2D
FIG. 5
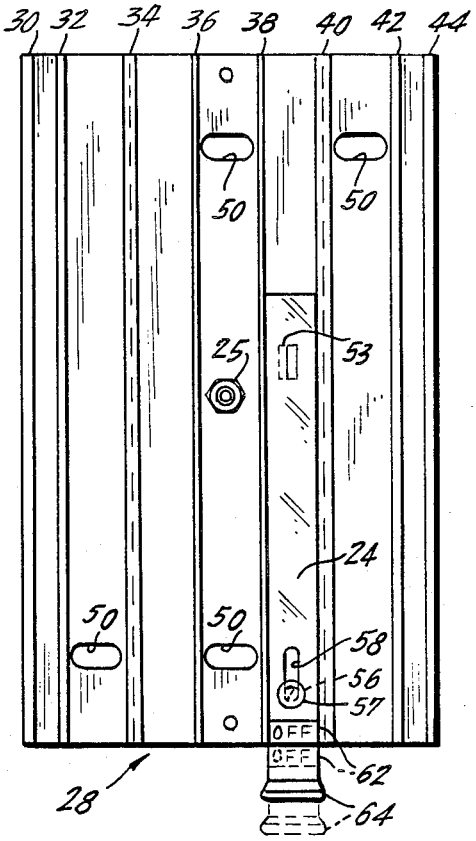

FIG. 6.
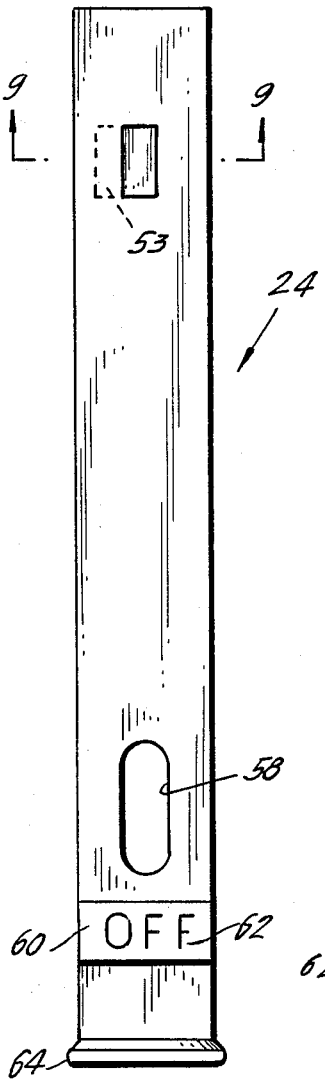
FIG. 7.
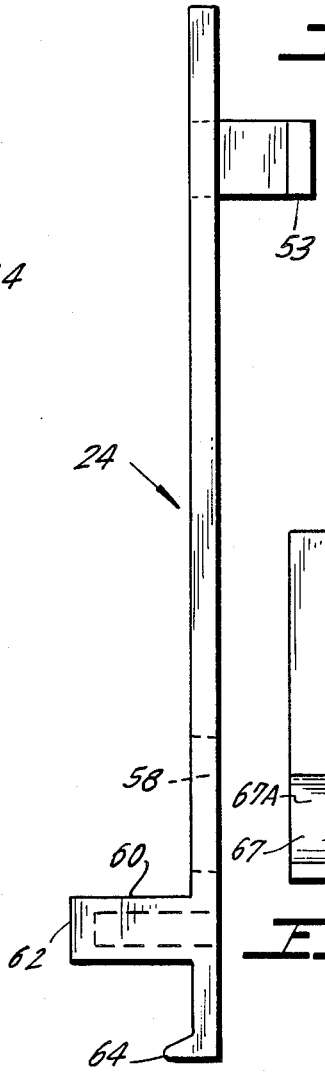
FIG. 11.
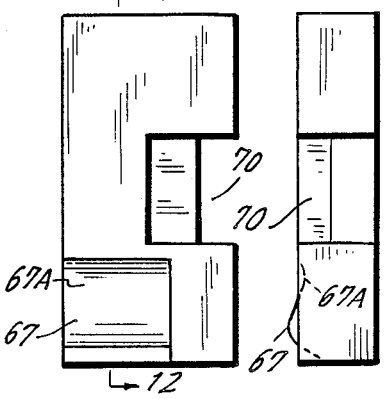
FIG. 10.
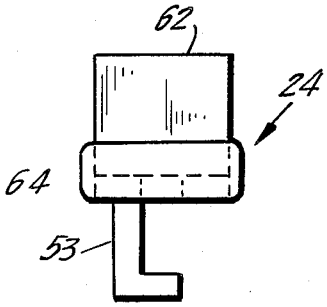
FIG. 8.
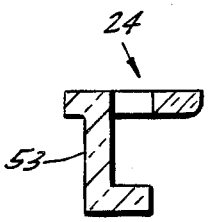
FIG. 9.
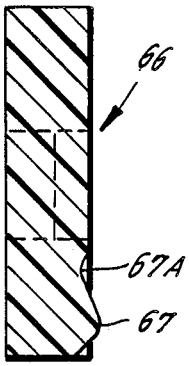
FIG. 12.

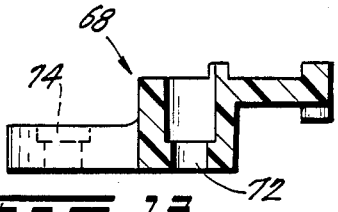
FIG. 13.
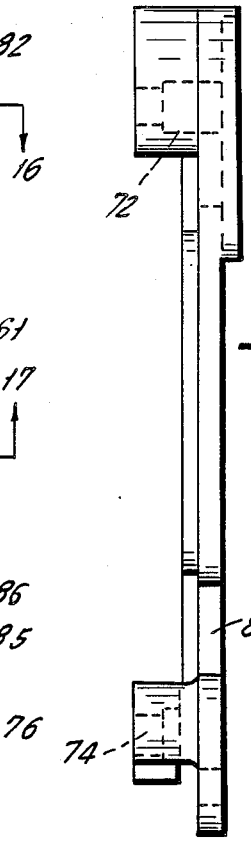
FIG. 16.
FIG. 14.
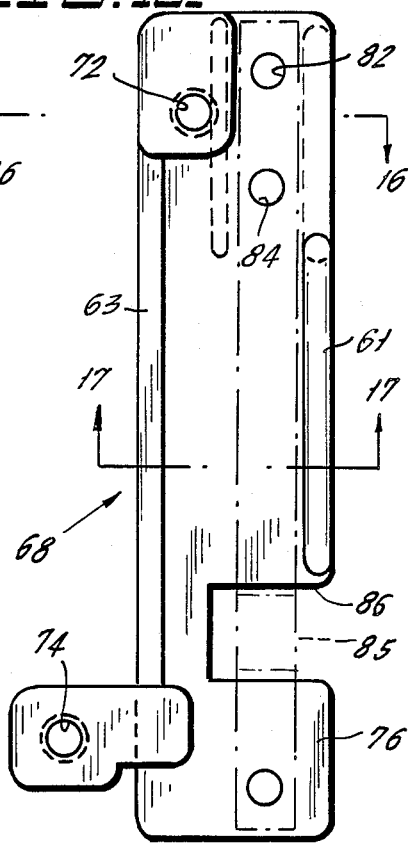
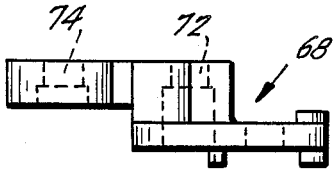
FIG. 15.
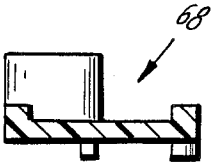
FIG. 17.

AIR GAP SWITCH ASSEMBLY

BACKGROUND OF THE INVENTION

This invention relates to switch assemblies, and more specifically to an air gap switch assembly with a lever that serves to both control and indicate the position of the air gap switch.

The control of electrical fixtures such as lights is often accomplished by using a solid state electronic device (i.e. a triac) which is controlled by an electronic control circuit. Such devices are safe and generally very reliable. However, since there is no physical open circuit when the solid state device is turned off, the normal leakage current through such a device (or its control circuit) can unknowingly result in a hazardous condition even when the device is in the OFF condition. Accordingly, Underwriters Laboratories (UL) requires that such solid state devices be connected in series with an air gap switch.

Even where an air gap switch, such as the contact of a relay, is used in lieu of the solid state electronic device, the control circuit for the relay is often connected in parallel with the relay. In such a case, there can be leakage current through the control circuit even when the relay is in the open position. For this reason, it is preferable to utilize an air gap switch in series with the relay contact.

In most prior art assemblies, a separate control lever, such as a toggle, is provided to operate the air gap switch. By way of example, the control lever may protrude from the bottom of the cover plate of the device. As shown in FIG. 1, the control lever for such a switch is always visible, which detracts from the appearance of the assembly. Moreover, such a control lever provides no obvious visual indication of the ON/OFF status of the air gap switch, and the user must operate the solid state device in order to determine the status of the air gap switch.

A more satisfactory structure is disclosed in U.S. Pat. No. 3,746,923 to Spira et al. The Spira et al device is a dimmer circuit having a dimmer control slider whose position controls the operation of a solid state device so as to adjust the power level to a load. The air gap switch is connected to a camming arrangement which opens the air gap switch when the slider reaches the lowermost position of its travel. This is an advantageous arrangement since it obviates the need for a separate air gap switch control lever. It also provides an indicator of the position of the air gap switch since the switch will only be open when the slider is in its lowermost position. However, it is sometimes desirable to operate the air gap switch independently of the dimmer control slider.

SUMMARY OF THE INVENTION

In accordance with the present invention, an air gap switch assembly is formed in which the control lever for the switch extends outside the housing of the assembly and is moveable relative to the housing. The lever is preferably formed of a clear material so that the portion which extends outside the housing is difficult to see. A status indicator is located on the control lever in a position where it is hidden from view by the housing of the assembly when the switch is set in a first (e.g. on) position. When the lever is moved so that the switch is set in a second (e.g. off) position, the portion of the lever on which the status indicator is located is exposed so that the status indicator becomes highly visible, thereby providing an indication that the switch has been set to the second position.

In a preferred embodiment of the invention, the control lever is coupled to a cam which cooperates with an elongated metal strip to open or close a pair of electrical contacts defining the air gap switch. When the control lever is moved to a position which causes the metal strip to flex against its bias such that an air gap is established between the two electrical contacts, the status indicator is exposed and provides a clear visual indication that the air gap switch has been set to the OFF position. When the strip is released by movement of the lever such that the air gap between the electrical contacts is closed and the switch is in the ON position, the status indicator disappears from view. The present invention thus provides an aesthetically pleasing air gap switch assembly which is simple to construct, inexpensive to manufacture, and which provides a clear indication of the state of the air gap switch.

BRIEF DESCRIPTION OF THE DRAWINGS

For the purpose of illustrating the invention, there is shown in the drawing a form which is presently preferred, it being understood, however, that the invention is not limited to the precise arrangement and instrumentality shown.

FIG. 5 is a front plan view of the control lever installed in the heat sink of FIG. 4.

FIG. 6 is a front plan view of the control lever of the present invention.

FIG. 7 is a side view of the control lever of FIG. 6.

FIG. 8 is a bottom view of the control lever of FIG. 6.

FIG. 9 is a cross sectional view of FIG. 6 taken at cross section line 9—9.

FIG. 10 is a front plan view of a cam connecting the control lever to the air gap switch.

FIG. 11 is a side view of the cam of FIG. 9.

FIG. 12 is another side view of the cam taken at cross section line 12—12 of FIG. 10.

FIG. 13 is a front plan view of the cradle of the present invention.

FIG. 14 is a side view of the cradle of FIG. 13.

FIG. 15 a bottom view of the cradle of FIG. 13.

FIG. 16 is a cross sectional view of the cradle of FIG. 13 taken across line 16—16.

FIG. 17 is a cross sectional view of the cradle of FIG. 13 taken across section line 17—17.

FIG. 20 is a cross-sectional side view of the present invention with the switch in the ON position.

DETAILED DESCRIPTION OF THE PREFERRED EMBODIMENT

Figure 2:
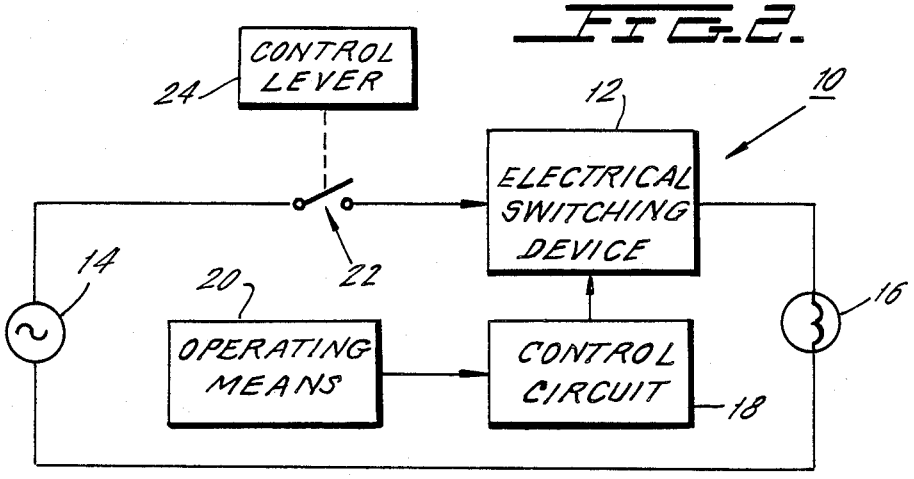
FIG. 2 is a schematic diagram of a load control circuit utilizing the air gap switch assembly of the present invention.

Referring now to FIGS. 2–21 wherein like numerals indicate like elements, there is shown in FIG. 2 a schematic diagram of the load control circuit utilizing the air gap switch assembly of the present invention and designated generally as 10. Air gap switch assembly 10 includes an electrical switching device 12 (e.g. a relay or triac) which controls the application of power from a source 14 to a load 16 (e.g. one or more lamps). The operation of the electrical switching device 12 is controlled by a control circuit 18 in response to the operation of an operating means 20. Control circuit 18 will typically operate switching device 12 in either a dimming mode as disclosed in U.S. Pat. No. 3,746,923 or in an ON/OFF mode as disclosed in co-pending application Ser. No. 791,318, filed Oct. 25, 1985. The disclosure of the foregoing copending application is incorporated herein by reference.

When control circuit 18 operates electrical switching device 12 in a dimming mode, the operating means 20 is typically a rotary or slide resistor. When control circuit 18 operates switching device 12 in an ON/OFF mode, operating means 20 is typically a push button switch. In any event, it is preferable to provide an air gap switch 22 in series with the electrical switching device 12. The air gap switch 22 is movable between an open and a closed position in response to the operation of a control lever 24.

Whereas FIG. 2 shows airgap switch 22 located between source 14 and electrical switching device 12; it can alternatively be located between electrical switching device 12 and load 16.

The electrical switching device 12, control circuit 18, operating means 20 and an air gap switch 22 are preferably located in an insulation casing 23 (see FIG. 3) attached to heat sink 28 forming part of housing 26. The switching device 12 is preferably mounted directly on the heat sink 28.

In the presently preferred embdiment, the operating means is a push button switch whose operating shaft 25 extends through the heat sink 28. The operating shaft 25 is in contact with an operating plate 27 which is resiliently coupled to the face plate 46 which is coupled to the front of the heat sink 28. Whenever the operating plate 27 is depressed by the operation of switch assembly, it biases operating shaft 25 rearwardly thereby closing the push button switch. The specific structure and operation of the push button switch 20 and the operating plate 27 is disclosed in detail in copending application Ser. No. 773,776 filed Sept. 6, 1985, the disclosure of which is incorporated herein by reference.

Figure 1:
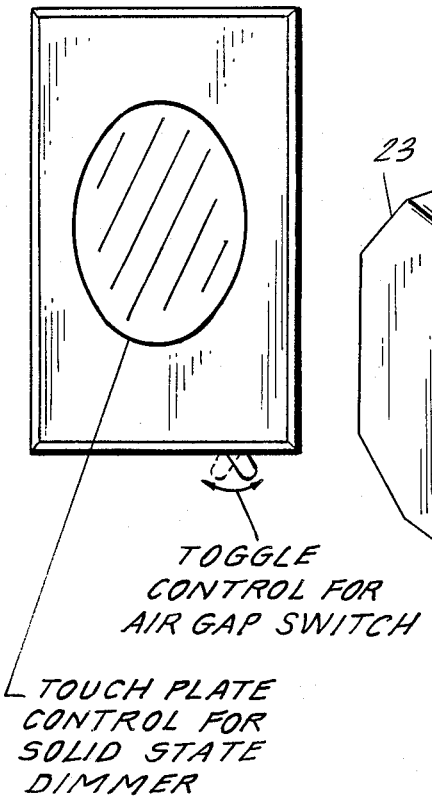
FIG. 1. PRIOR ART
FIG. 1 is a front view of a prior art device utilizing an ON/OFF toggle switch protruding from the bottom of the device to control an air gap switch assembly.
Figure 3:
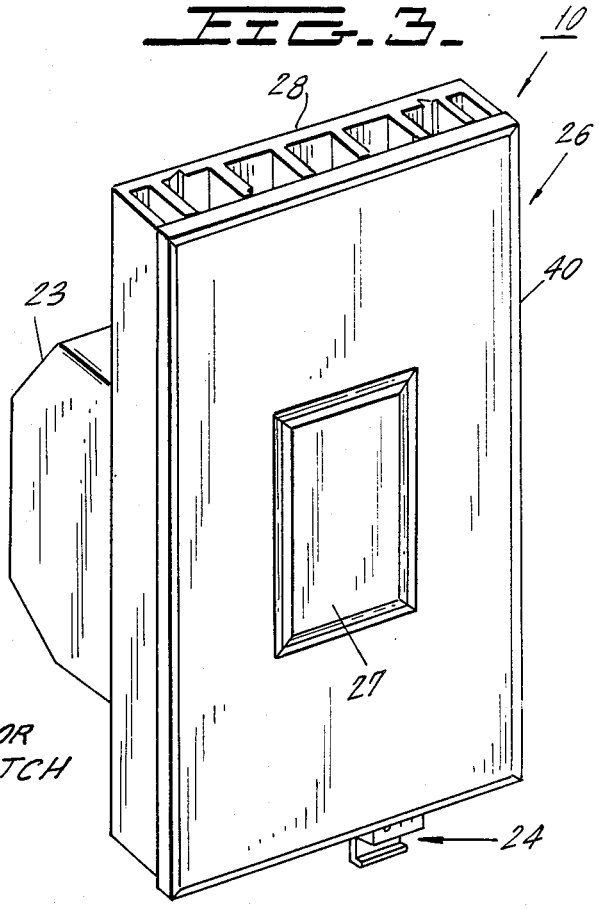
FIG. 3 is a perspective view of a wall box housing with which the air gap switch assembly is associated.
Figure 4:
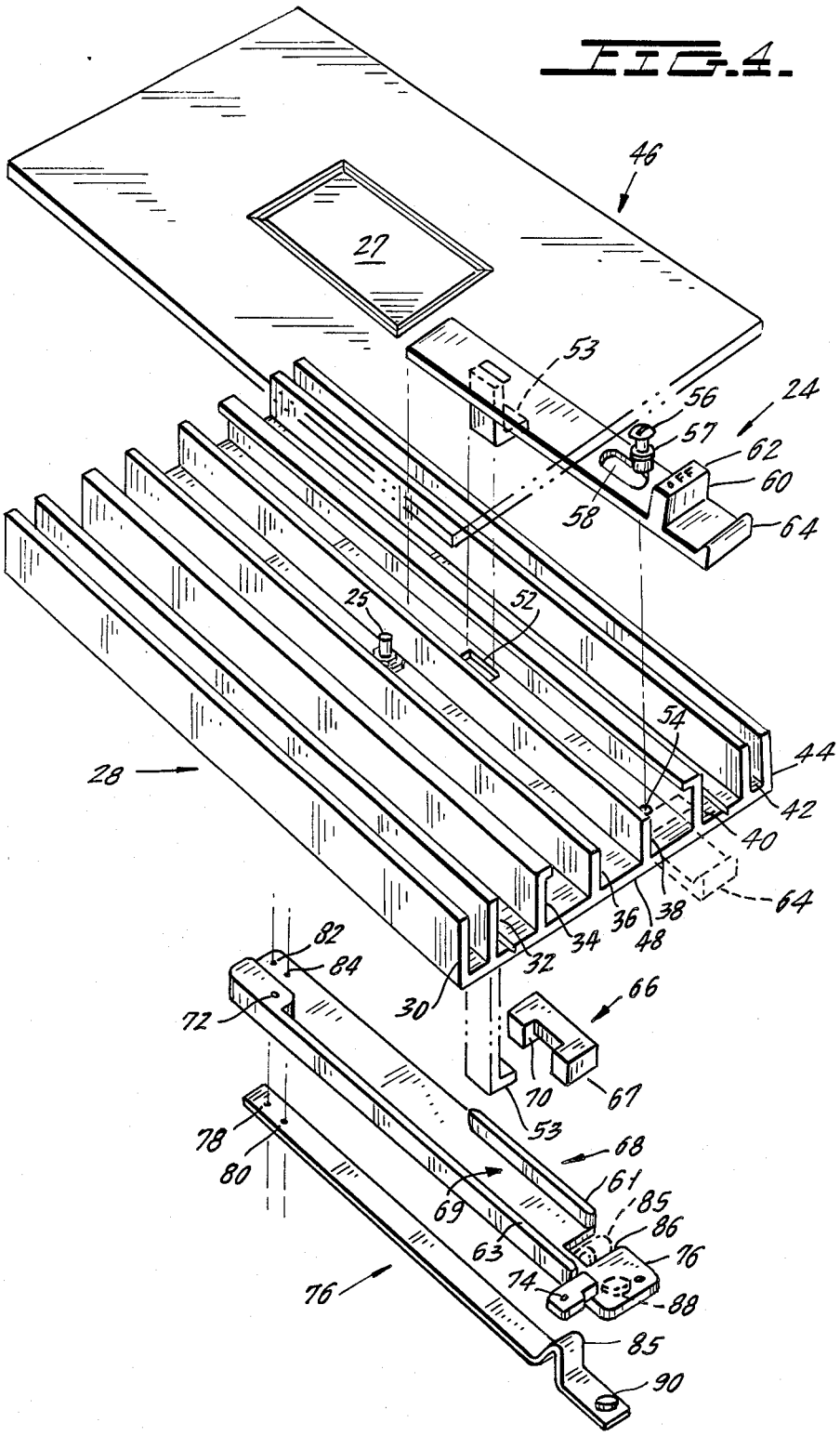
FIG. 4 is an exploded perspective view of an embodiment of the present invention.

While the operating means 20 is illustrated in FIGS. 3 and 4 as a push button switch located in the center of the face plate 46, the invention is not limited to such a device. The operating means can also be a slider, such as shown in U.S. Pat. No. 3,746,923, a touch plate or any other human actuable device. The air gap switch of the present invention need not be used in connection with a human operable operating means 20. Thus, the control circuit 18 can receive signals from a remote source, such as a microprocessor. The operating means could take the form of a receiver which is controlled by a wireless remote transmission unit (e.g. an infrared transmitter).

As best shown in FIG. 4, the heat sink 28, which may be an extruded aluminum member which may have a plurality of fins 30–44, and the face plate 46 cooperate to define a housing 26. A plurality of tabs (not shown) located on the underside of face plate 46 cooperate with the ends of fins 34 and 40 to enable the face plate 46 to be snapped onto and off of the heat sink 28. The heat sink 28 includes a flat wall 48 which defines the rear wall of the housing 26, the outer fins 30, 44 defining the side wall of the housing. The face plate 46 defines the front wall of the housing.

The control lever 24 which operates the air gap switch 22 is located primarily in housing 26, but includes a distal end which extends out of housing 26. The lever 24 is slidable relative to housing 26 so that the distance which the distal end of lever 24 extends out of the housing varies as a function of the position of the lever 24 relative to the housing 26.

Referring now to FIG. 5, a plurality of openings 50 are provided in heat sink 28 for receiving screws (not shown) to mount the heat sink, and thus the entire housing 26 and attached casing 23, to a conventional wall box.

The control lever 24 is preferably positioned between fins 38 and 40 of the heat sink and is slidably coupled to heat sink 28. A slot 52 is formed in the base plate 48 and permits an L-shaped hook 53 which is coupled to the control lever 24 to extend through the heat sink 28 to the rear side thereof. As will be explained in greater detail below, the bottom leg of the L-shaped hook 53 extends into a cutout portion 70 in a cam 66 which rides in a raceway 69 defined by side rails 61, 63 formed in a cradle 68. The L-shaped hook 53, slot 52 and raceway 69 cooperate to insure that the top portion of lever 24 is linearly slidable relative to heat sink 28.

An elongated slot 58 is formed near the bottom of control lever 24 and cooperates with the shoulder washer 57 and a metal screw 56 to slidably mount the bottom portion of lever 24 with respect to the heat sink 28. The metal screw 56 is screwed into a tapped hole 54 formed in the heat sink 28.

Lever 24 is shown in greater detail in FIGS. 6–9. Referring to the front and side views shown in FIGS. 6 and 7, respectively, lever 24 has a raised portion 60 which, on its front surface 62, is labelled OFF. On the end of lever 24 near raised portion 60 is a lip 64 which is provided to allow an operator of the assembly to grasp the lever with his finger tip or nail for up and down movement. L-shaped hook 53 is shown in greater detail in FIGS. 8 and 9.

Referring to FIG. 4, hook 53 of lever 24 passes through slot 52 of heat sink 28 and, on the underside of heat sink 28, engages a cam 66. Cam 66, shown in detail in FIGS. 10–12, is slidably positioned between the rear surface 48 of heat sink 28 and a cradle 68. The hook 53 of lever 24 passes through slot 52 of heat sink 28 and fits into cut out portion 70 of cam 66 to couple lever 24 and cam 66 together. Cradle 68, shown in greater detail in FIGS. 13–17, holds cam 66 against the rear surface 48 of heat sink 28. Cradle 68 is secured to heat sink 28 by means of eyelets or screws (not shown) which pass through openings 72 and 74 in the cradle. On the underside of cradle 68 rests an elongated flat metal strip 76 which is secured to cradle 68 by two rivets which pass through and couple points 78 and 80 of strip 76 to points 82 and 84 of cradle 68. A U-shaped section 85 is formed in strip 76 which extends through an opening 86 in cradle 68. Cradle 68 also includes an electrical contact member 88 riveted to its underside and is aligned with a corresponding electrical contact member 90 on the facing side of strip 76. Contact members 88 and 90 together comprise the air gap switch 22 of the present invention.

Figure 18:
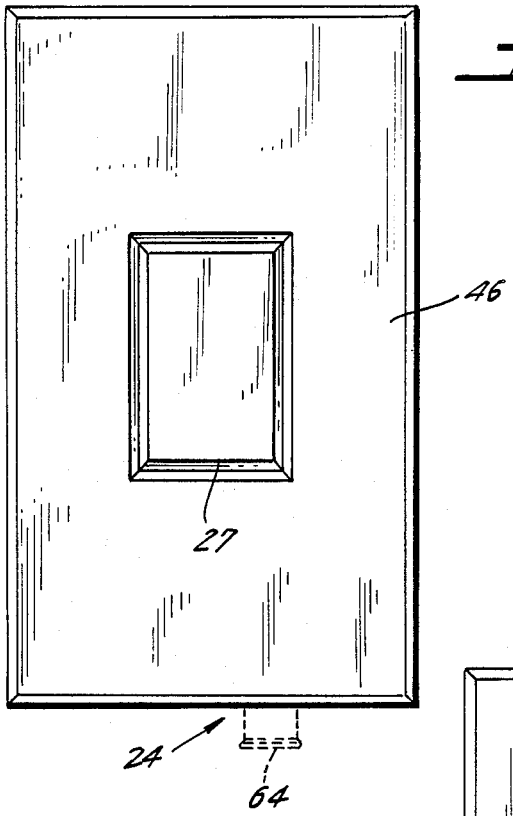
FIG. 18 is a front view of the assembly with the control lever in the ON position.
Figure 19:
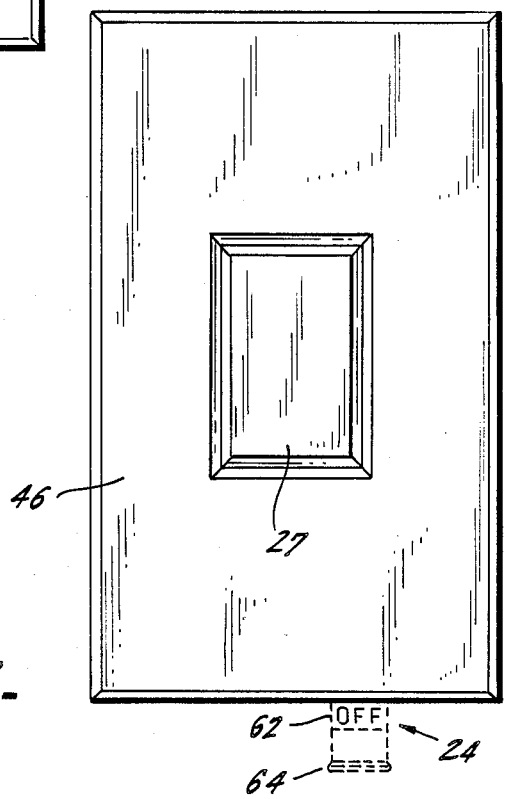
FIG. 19 is a front view of the assembly with the control lever in the OFF position.

Referring now to FIG. 5, the lettering OFF on raised portion 60 of control lever 24 moves in and out of housing 26 as control lever 24 is slid up and down in heat sink 28. As shown by FIGS. 18 and 19, which represent front views of the assembly from about 5 feet away, face plate 46 obscures lever 24 almost entirely when lever is in its raised position, only lip 64 of the lever protruding from the bottom of housing 26. Advantageously, control lever 24 is formed of a clear plastic material (e.g. lexan) which makes it difficult to see from a distance. To this end, the surface of the plastic material is formed of either a smooth or a matted finish. It should not be formed with a saw tooth or similar finish which would make it relatively easy to see. Accordingly, as shown by the dotted lines in FIG. 18, even through lip 64 protrudes from housing 26, it is not seen by the casual observer from a distance of about 5 feet. As shown in FIG. 19, when the control lever is moved to its lower position, the opaque OFF lettering on the front portion 62 of raised portion 60 becomes prominently visible to the observer, but the exposed portion of lever 24 itself is difficult to see. Thus, when air gap switch 22 is ON, control lever 24 essentially disappears from view, and the observer sees only housing 26.

When the air gap switch 22 is OFF, the observer sees the letters OFF prominently appear at the bottom of housing 26. Obviously, the above-described embodiment is only one of a number of possible ways to indicate the status of the air gap switch 22 in accordance with the present invention. For instance, only the ON status, rather than the OFF status, of air gap switch 22 could be indicated. As further examples, lever 24 could be rotated, rather than slid, in housing 26, or the indicator could be a luminating device rather than lettering.

The operation of the present invention will now be described in connection with FIGS. 20 and 21. Referring first to FIG. 20, air gap switch 22 is shown in the ON position with lever 24 moved upward so that raised portion 60 is hidden from view. With the control lever 24 in the raised position, cam 66 is also moved to its uppermost position by means of hook 53. With cam 66 in its uppermost position, the forward bias of strip 76 (bias to the left in FIG. 20) causes U-shaped section 85 of strip 76 to extend fully through opening 86 in cradle 68, forcing contacts 88 and 90 of air gap switch 22 to abut against one another in electrical contact.

Figure 21:
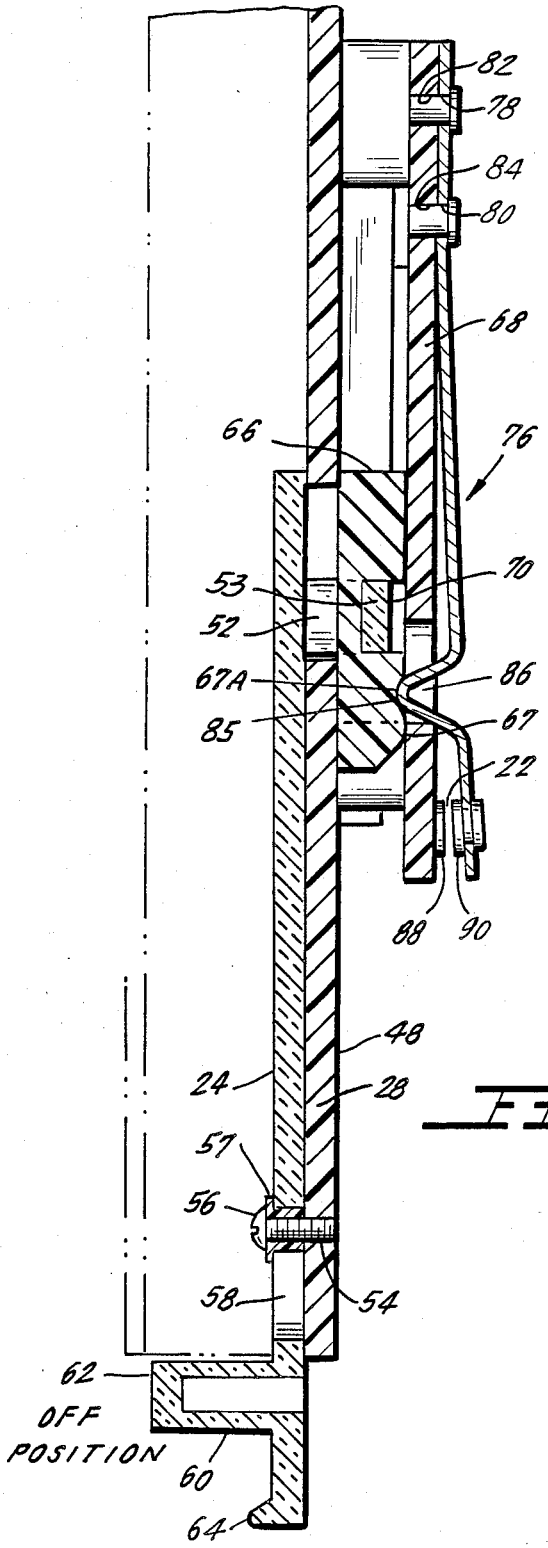
FIG. 21 is a cross-sectional side view of the present invention with the switch in the OFF position.

As shown in FIG. 21, when lever 24 is lowered to its OFF position, raised portion 60 is exposed, so that the opaque lettering OFF is now visible to the observer. Since lever 24 is coupled to cam 66 through hook 53, cam 66 also moves downward a corresponding distance, causing abutting cam surface 67 to engage U-shaped section 85 and force strip 76 backward (to the right in FIG. 21), thereby opening the contact between contact members 88 and 90 of air gap switch 22. With lever 24 moved to its bottommost position, U-shaped section 85 rests in a stable position in indentation 67A of cam surface 67.

Although this invention has been described with respect to its preferred embodiment, it should be understood that many variations and modifications will now be obvious to those skilled in the art, and it is preferred, therefore, that the scope of the invention be limited not by the specific disclosure herein but only by the appended claims.

What is claimed is:

1. An air gap switch assembly, commprising:

a housing;

an air gap switch coupled to said housing and being moveable between an open and closed position;

a control lever extending from a position inside said housing to a position outside said housing and moveable relative to said housing so that the distance that said lever extends outside said housing varies as a function of the position of said lever relative to said housing; said control lever being moveable between an ON position wherein it causes said switch to be in said closed position and an OFF position wherein it causes said switch to be in said open position; at least a portion of said lever extending outside said housing in both the ON and OFF positions, the entire portion of said lever which extends outside said housing being formed of a transparent material which makes said portion difficult to see in both said ON and OFF positions; and a status indicator located on said lever at a position which is located outdside said housing when said lever is in one of said ON and OFF positions and which is located inside said housing when said lever is in the other of said ON and OFF positions, said status indicator being highly visible relative to said transparent material.

2. The air gap switch assembly of claim 1, wherein said lever is linearly moveable relative to said housing.

3. The air gap switch assembly of claim 2, wherein said housing includes a heat sink having a plurality of spaced parallel fins and wherein said control lever is slideably positioned between an adjacent pair of said fins.

4. The air gap switch assembly of claim 1, wherein said status indicator is the word OFF.

5. The air gap switch assembly of claim 1, wherein said lever includes a projecting lip near the bottom thereof to assist the operator of said assembly in moving said lever, said projecting lip being located outside of said housing when said lever is both in said ON position and when said lever is in said OFF position.

6. The air gap switch assembly of claim 1, wherein said housing has a front side and a rear side, said lever has a planar main section located adjacent said rear side of said housing and a protruding portion extending from said planar main section to a position adjacent said front side of said housing, said status indicator being located on a front surface of said protruding portion.

7. The air gap switch assembly of claim 6, wherein said lever has a projecting lip formed near the distal end of said lever for aiding the operator of said assembly in moving said switch, said lip being located outside said housing both when said lever is in said ON position and when said lever is in said OFF position.

8. The air gap switch assembly of claim 7, wherein the distance said lip projects from said planar main section toward said front side of said housing is less than the distance said protruding portion projects from said planar main section toward said front side of said housing.

9. The air gap switch assembly of claim 1, further including an electronic switching element coupled in series with said air gap switch, a control circuit for controlling the operation of said switching element, and a human actuable control, separate from said control lever, for controlling the operation of said control circuit.

10. The air gap switch assembly of claim 9, wherein said housing has a front surface and at least one side surface, said human actuable control being located on said front surface, said control lever extending through a said side surface.

11. The air gap switch of claim 10, wherein said side surface is a bottom side surface of said housing.

12. The air gap switch assembly of claim 1, wherein said housing has a front wall and a rear wall, said air gap switch is located outside said housing adjacent said rear wall and said lever includes a portion extending through said rear wall and being coupled to said air gap switch.

13. The air gap switch assembly of claim 12, wherein;

said air gap switch comprises a first contact member and a second contact member;

said control lever is moveable to cause said first and second contact members to be in electrical contact when said switch ie in said ON position and said contact members to be separated by an air gap when said switch is in said OFF position;

said first contact member is biased toward said second contact member, and said bias is provided by a flat metal strip, said strip being moveable against its bias when sad control lever is moved from said ON position to said OFF position.

14. The air gap switch assembly of claim 13, wherein said portion of said control lever extending through said rear wall is coupled to a cam, said cam being slidably moveable on said rear wall, said cam causing said strip to move against its bias when said control lever is moved from said ON position to said OFF position.

15. An air gap switch assembly, comprising:

a housing;

an air gap switch coupled to said housing and moveable between an open and a closed position;

an electronic switching element coupled in series with said air gap switch such that when said series connected air gap switch and electronic switching element are coupled in series with a power soource and a load, power is applied to said load whenever said air gap switch is in said closed position and said electronic switching element is ON and power is removed from said load whenever either said air gap switch is in said open position of said electronic switching element is OFF;

a control circuit for controlling the operation of said switching element;

a control lever extending from a postion inside said housing to a position outside said housing and moveable relative to said housing so that the distance that said lever extends outside said housing varies as a function of the position of said lever relative to said housing, said control lever being moveable between an ON position wherein it causes said switch to be in a closed position, and an OFF position wherein it causes said switch to be in said open position;

a status indicator located on said lever at a position which is located outside said housing when said lever is in one of said ON an OFF positions and which is located inside said housing whenever said lever is in the other of said ON and OFF positions; and a human actuable control, separate from said control lever, for controlling the operation of said control circuit.

16. The air gap switch assembly of claim 15, wherein said lever is linearly moveable relative to said housing.

17. The air gap switch assembly of claim 16, wherein said housing includes a heat sink having a plurality of spaced parallel fins and wherein said control lever is slideably positioned between an adjacent pair of said fins.

18. The air gap switch assembly of claim 15, wherein said status indicator is the word OFF.

19. The air gap switch assembly of claim 15, wherein said lever includes a projecting lip near the bottom thereof to assist the operator of said assembly in moving said lever, said projecting lip being located outside of said housing when said lever is both in said ON postion and when said lever is in said OFF position.

20. The air gap switch assembly of claim 15, wherein said housing has a front side and a rear side, said lever has a planar main section located adjacent said rear side of said housing and a protruding portion extending from said planar main section to a position adjacent said front side of said housing, said status indicator being located on a front surface of said protruding portion.

21. The air gap switch assembly of claim 20, wherein said lever has a projecting lip formed near the distal end of said lever for aiding the operator of said assembly in moving said switch, said lip being located outside said housing both when said lever is in said ON position and when said lever is in said OFF position.

22. The air gap switch assembly of claim 21, wherein the distance said lip projects from said planar main section toward said front side of said housing is less than the distance said protruding portion projects from said planar main section toward said front side of said housing.

23. The air gap switch assembly of claim 15, wherein said housing has a front wall and a rear wall, said air gap switch is located outside said housing adjacent said rear wall and said lever includes a portion extending through said rear wall and being coupled to said air gap switch.

24. The air gap switch assembly of claim 23, wherein said air gap switch comprises a first contact member and a second contact member, said control lever is moveable to cause said first and second contact members to be in electrical contact when said switch is in said ON position and said contact members to be separated by an air gap when said switch is in said OFF position, said first contact member is biased toward said second contact member, and said bias is provided by a flat metal strip, said strip being moveable against its bias when said control lever is moved from said ON position to said OFF position.

25. The air gap switch assembly of claim 24, wherein said portion of said control lever extending through said rear wall is coupled to a cam, said cam being slidably moveable on said rear wall, said cam causing said strip to move against its bias when said control lever is moved from said ON position to said OFF position.

26. The air gap switch assembly of claim 15, wherein said housing has a front surface and at least one side surface, said human actuable control being located on said front surface, said control lever extending through a said side surface.

27. The air gap switch of claim 26, wherein said side surface is a bottom side surface of said housing.

28. The air gap switch assembly of claim 15, wherein said human actuable control is a mechanical control element.

* * * * *